United States Patent [19]

Leng et al.

[11] Patent Number: 4,615,819

[45] Date of Patent: Oct. 7, 1986

[54] DETERGENT GEL COMPOSITIONS IN HEXAGONAL LIQUID CRYSTAL FORM

[75] Inventors: Francis J. Leng, Merseyside; David Machin, Cheshire; David A. Reed, Merseyside, all of England; Ozalp Erkey, Istanbul, Turkey

[73] Assignee: Lever Brothers Company, New York, N.Y.

[21] Appl. No.: 703,631

[22] Filed: Feb. 21, 1985

[30] Foreign Application Priority Data

Feb. 26, 1984 [GB] United Kingdom ..... 8405266

[51] Int. Cl.[4] ..... C11D 1/37; C11D 10/04; C11D 17/00

[52] U.S. Cl. ..... 252/110; 252/117; 252/121; 252/525; 252/526; 252/528; 252/529; 252/532; 252/534; 252/538; 252/539; 252/540; 252/544; 252/545; 252/547; 252/548; 252/551; 252/553; 252/557; 252/558; 252/559; 252/DIG. 16; 252/174

[58] Field of Search ..... 252/550, 551, 553, 547, 252/554, 558, 559, 532, 533, 535, 539, 540, 528, 121, DIG. 16, 557, 538, 110, 117, 174

[56] References Cited

U.S. PATENT DOCUMENTS

| | | | |
|---|---|---|---|
| 2,580,713 | 1/1952 | Wood | 252/121 |
| 2,978,416 | 4/1961 | Fein et al. | 252/559 |
| 3,174,935 | 3/1965 | Eccles et al. | 252/558 |
| 3,175,977 | 3/1965 | Smithson et al. | 252/558 X |
| 3,440,171 | 4/1969 | Warren | 252/558 X |
| 3,839,213 | 10/1974 | Hill | 252/101 X |
| 3,849,347 | 11/1974 | Tokiwa et al. | 252/545 |
| 4,243,549 | 1/1981 | Messenger et al. | 252/355 |
| 4,257,908 | 3/1981 | Wixon | 252/135 |
| 4,328,131 | 5/1982 | Carson et al. | 252/542 |
| 4,532,076 | 7/1985 | Schmid et al. | 252/557 |

FOREIGN PATENT DOCUMENTS

| | | |
|---|---|---|
| 1070590 | 1/1980 | Canada . |
| 1236665 | of 0000 | France . |
| 5154855 | 5/1976 | Japan . |
| 36599 | 4/1981 | Japan . |
| 162799 | 10/1982 | Japan . |
| 138800 | 8/1983 | Japan . |
| 122600 | 7/1984 | Japan . |
| 1029043 | 5/1966 | United Kingdom . |
| 1129385 | 10/1968 | United Kingdom . |
| 1370377 | 10/1974 | United Kingdom . |
| 1382295 | of 0000 | United Kingdom . |
| 1408525 | of 0000 | United Kingdom . |
| 1434087 | 4/1976 | United Kingdom . |
| 2053954 | 2/1981 | United Kingdom . |

OTHER PUBLICATIONS

V. Luzzati, "Biological Membranes: Physical Fact and Function", ed. D. Chapman, Acadamic Press, London and New York, 1978 Chapter 3, p. 7.

D. G. Hall and G. J. T. Tiddy, "Anionic Surfactants: Physical Chemistry of Surfactant Action", (Volume of Surfactant Science Series), ed. E. H. Lucassen-Reynders, Marcel Dekker, New York, 1981, Chapter 2, pp. 91-94.

M. P. McDonald and W. E. Peel, "Solid and Liquid Crystalline Phases in the Sodium Docecyl Sulphate+-Hexadecanoic Acid+Water System", J. Chem. Soc. Faraday Trans. 1,72,2274, (1976).

*Primary Examiner*—Prince E. Willis

*Attorney, Agent, or Firm*—Milton L. Honig; James J. Farrell

[57] ABSTRACT

Detergent compositions comprising stable transparent, translucent or opaque hexagonal phase gels contain an anionic or cationic surfactant which is "secondary", i.e. its polar head group is either positioned non-terminally on a hydrophobic chain or carries two or more hydrophobic chains; optionally a further surfactant which is nonionic or non-"secondary"; a material (the "additive") capable of forcing the surfactant system into hexagonal phase; optionally builder, perfume, coloring or other adjuncts; and water. A solid such as abrasive or insoluble builder may be suspended in the gel. Preferred gels of the invention contain alkylbenzene sulphonate or dialkyl sulphosuccinate as the "secondary" surfactant and urea as the "additive". The compositions may be used inter alia for manual dishwashing.

25 Claims, No Drawings

DETERGENT GEL COMPOSITIONS IN HEXAGONAL LIQUID CRYSTAL FORM

The present invention relates to detergent compositions in the form of a stable transparent, translucent or opaque water-soluble gel. The compositions of the invention are especially suitable for washing dishes or other hard surfaces, but are also of use for other cleaning purposes, for example, fabric washing.

Detergent compositions in gel form have been described in the literature. GB No. 1 370 377 (Procter & Gamble) discloses a detergent gel for hard-surface cleaning, containing an anionic surfactant, polyhydric alcohol, an inorganic salt and a suspending agent. CA No. 1 070 590 (Colgate) discloses a translucent stable single-phase gel containing alkyl ether sulphate, potassium pyrophosphate, water and solvent. JP No. 51/54855 (Nippon Synthetic Chemistry KK) discloses a soft gel containing a sulphonated fatty acid salt together with an organic or nonionic surfactant. These prior art compositions are relatively soft gels based on lamellar phase liquid crystals.

It is also known that sulphonated anionic detergents, such as alkylbenzene sulphonates, tend to form gels at high concentrations and this is regarded as undesirable because of the associated processing problems. For example, GB No. 1 129 385 (Atlantic Richfield) describes the difficulties encountered with the handling of alkanolamine linear alkylbenzene sulphonates at concentrations of 45% by weight and above, when gelling or partial gelling may occur unless degelling agents such as sodium sulphate or hexylene glycol are present. These gels too are based on lamellar phase liquid crystals.

It has now been discovered that stable transparent translucent or opaque gels of high viscosity based on a combination of one or more surfactants, an additive and water may be prepared in which the surfactant system is wholly or predominantly in hexagonal liquid crystal phase, provided that a suitable surfactant system and a suitable additive are chosen. The gels are aesthetically attractive and display excellent foaming and detergency.

The present invention accordingly provides an aqueous detergent composition comprising or consisting of a gel wholly or predominantly in hexagonal liquid crystal form, the gel comprising:

(a) a surfactant system having a Krafft point below ambient temperature, said system being incapable of forming hexagonal phase spontaneously, and consisting essentially of:

(i) 30 to 100% by weight of an anionic or cationic surfactant, having a polar head group and one or more linear or branched aliphatic or araliphatic hydrocarbon chains containing in total at least 8 aliphatic carbon atoms, the polar head group being positioned non-terminally in a single hydrocarbon chain or carrying more than one hydrocarbon chain; or two or more such surfactants of the same charge type; and (ii) optionally 0 to 70% by weight of a further surfactant selected from surfactants of the same charge type as (i) but having a polar head group positioned terminally in a linear or branched aliphatic or araliphatic hydrocarbon chain containing at least 8 aliphatic carbon atoms; nonionic surfactants; and mixtures thereof;

(b) an "additive" which is a water-soluble non-micelle-forming or weakly micelle-forming material capable of forcing the surfactant system (a) into hexagonal phase, the additive being nonionic or of the same charge type as the surfactant (a)(i); and (c) water.

For the purposes of the present invention, surfactants of the type (a)(i), in which the head group is non-terminal, will be referred to as "secondary", while surfactants in which the head group occupies a terminal position on the hydrocarbon chain, such as the charged surfactants defined under (a)(ii), will be referred to as "primary". In the gels of the invention, a "secondary" surfactant is always present, and a "primary" surfactant of the same charge type or a nonionic surfactant may optionally be present.

In a "secondary" surfactant, the polar head group is either attached to the hydrophobic hydrocarbon chain in a non-terminal position, or itself occupies a non-terminal position within the chain, that is to say, two or more shorter chains are directly attached to the head group itself. The first type of "secondary" surfactant will generally conform to the general formula I

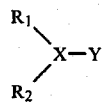

(I)

wherein Y is the charged head group, for example, a sulphonate or sulphate group; $R_1$ and $R_2$ are aliphatic or araliphatic hydrocarbon chains the shorter of which contains at least 2 aliphatic carbon atoms; and X is a linking group such as

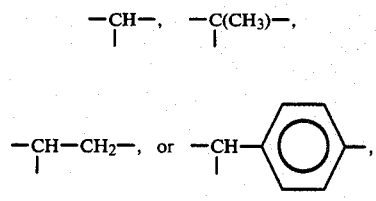

the total number of aliphatic carbon atoms in $R_1$, $R_2$ and X being at least 8, preferably 10 to 28.

Examples of this first type of "secondary" surfactant include alkylbenzene sulphonates, secondary alkane sulphonates and secondary alkyl sulphates. All these materials are generally random mixtures of isomers, and will include some material that is not "secondary", that is to say, with a terminally or near-terminally positioned head group; for the purposes of the present invention, however, it is only necessary for the average constitution of the material to be "secondary".

The second type of "secondary" surfactant will generally conform to the general formula II

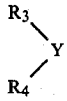

(II)

wherein Y is the charged head group, and $R_3$ and $R_4$ are aliphatic or araliphatic hydrocarbon chains together containing at least 8, preferably 10 to 28, aliphatic carbon atoms, the shorter of the chains $R_3$ and $R_4$ containing at least 2 aliphatic carbon atoms.

Examples of this second type of "secondary" surfactant are dialkyl sulphosuccinates, and quaternary ammonium salts such as di(coconut alkyl) dimethyl ammonium salts.

The upper limit for the total number of carbon atoms in the hydrocarbon chains of both the first and second types of "secondary" surfactants is in practice set by the requirement that the surfactant system as a whole must have a Krafft point below ambient temperature; this is essential for hexagonal phase formation. The lower limit of 8 aliphatic carbon atoms represents the minimum level of surface activity useful for detergent products.

The detergent gels of the invention are characterised by being wholly or predominantly in hexagonal liquid crystal form. This crystal form, also known as "middle" phase, may be recognised by various microscopic techniques, of which X-ray diffraction is the most definitive. Of the three liquid crystal forms—lamellar, hexagonal and cubic—it is intermediate in rigidity. The products of the invention are stiff gels. Preferred embodiments are transparent or translucent, and are sufficiently attractive in appearance for packaging in transparent containers.

Hexagonal or middle phase has been described in the scientific literature; see, for example, V. Luzzati, "Biological membranes: physical fact and function", ed. D Chapman, Academic Press, London and New York, 1978, Chapter 3, page 7; and D G Hall and G J T Tiddy, "Anionic surfactants: physical chemistry of surfactant action" (Volume of Surfactant Science Series), e.d. E H Lucassen-Reynders, Marcel Dekker, New York, 1981, Chapter 2, pages 91–94. It is well known that sodium dodecyl sulphate, a linear or "primary" surfactant in which a charged head group occupies a terminal position in a linear hydrocarbon chain, will form hexagonal phase spontaneously at certain concentrations when the only other material present is water. "Secondary" surfactants, however, will not form hexagonal phase at any concentration when the only other material present is water. The present invention is based on the discovery that such surfactants can be driven into hexagonal phase if an additional material having certain properties is present. For the purposes of the present invention this additional material required to effect the transition into hexagonal phase will be referred to as an "additive".

The gels of the invention thus contain three essential components: a surfactant system consisting at least in part of "secondary" surfactant; an "additive"; and water. Conventional adjuncts such as builder, perfume, colour and buffer may also be present subject to certain restraints on electrolyte level discussed below.

The compositions of the invention may consist entirely of hexagonal phase gel, but it is also possible for other phases, for example, solid particles or droplets of immiscible liquid, to be present, provided that a stable gel can still be obtained. Generally the weight ratio of other phase to gel should not exceed 1.5:1.

The gels of the invention preferably contain from 15 to 70% by weight of the surfactant system (a), more preferably from 25 to 60% by weight; from 1 to 45% by weight of the additive (b), more preferably from 5 to 35% by weight; and at least 20% by weight of water, more preferably 25 to 55% by weight. These figures refer to the gel phase alone, any other phases present not being included in the total on which the percentages are based.

In the simplest embodiment of the invention, the composition consists wholly of hexagonal phase gel, the surfactant system (a) consists wholly of secondary surfactant, and the composition may be a simple ternary mix of surfactant, additive and water, plus the optional adjuncts mentioned above.

This embodiment of the invention may be defined as a detergent composition in the form of a gel wholly or predominantly in hexagonal liquid crystal form, and comprising (a) an anionic or cationic surfactant having a polar head group and a hydrophobic aliphatic or araliphatic hydrocarbon chain containing at least 8 aliphatic carbon atoms, the polar head group being positioned non-terminally in the hydrocarbon chain, (b) an "additive" which is a water-soluble non-micelle-forming or weakly micelle-forming material capable of forcing component (i) into hexagonal phase, and (c) water.

The "secondary" surfactant must have an ionically charged head group. Nonionic surfactants appear not to give stable hexagonal phase gels in accordance with the invention. Thus the surfactant must be either cationic or anionic. The gels of the present invention in which the surfactant is cationic are useful, for example, as fabric conditioners or hair conditioners. Gels in which the surfactant is anionic are highly suitable for applications in which copious foaming and high detergency are required. In particular, they are of especial interest for manual dishwashing.

Preferred examples of "secondary" anionic surfactants that may be used in the gels of the invention include secondary alkane sulphonates, secondary alkyl sulphates, dialkyl sulphosuccinates and alkylbenzene sulphonates. These materials may have straight or branched alkyl chains. Of these materials, two classes are of especial interest: the linear or branched alkylbenzene sulphonates containing an average of 8 to 15 alkyl carbon atoms, preferably 10 to 13; and the linear or branched di($C_4$–$C_{10}$)alkyl sulphosuccinates, and more especially the linear di($C_6$–$C_8$)alkyl sulphosuccinates. Gels based on these surfactants have been found to exhibit excellent plate-washing performance and to be much more aesthetically attractive than opaque pastes based on alkylbenzene sulphonates. Such pastes are conventional dishwashing products in areas such as Turkey and the Middle and Far East.

When the "secondary" surfactant is anionic, its counterion may be any solubilising cation, provided that the Krafft point condition is satisfied. Examples include alkali metal, such as sodium, potassium, lithium or caesium; alkaline earth metal, such as magnesium; ammonium; and substituted ammonium, such as mono-, di- and trialkylamine and mono-, di- and trialkanolamine. Trialkanolamine salts, for example, triethanolamine salts, have the special advantage of a buffering action to pH 7–9 (the pK of triethanolamine is 8) which can be useful if components unstable at high or low pH are present. A further advantage of trialkanolamines accrues from their high molecular weight, which for a given composition reduces the water content and thereby increases the concentration of surfactant and "additive". In practice this increases the range of compositions over which robust commercial gels can be prepared. Magnesium cations are beneficial to soft water performance, and sodium salts are easy to prepare by neutralisation with caustic soda. The choice of cation is therefore very much a matter of preference.

As already indicated, the surfactant system of the compositions of the invention may optionally contain a further surfactant, (a)(ii), which is either a "primary" surfactant of the same charge type as the "secondary" surfactant, or a nonionic surfactant. Mixtures are also possible. The further surfactant (a)(ii) contains at least 8 aliphatic carbon atoms, preferably from 10 to 18 aliphatic carbon atoms.

If the "secondary" surfactant (a)(i) is of the type where the head group is randomly distributed about the hydrocarbon chain, as in alkylbenzene sulphonates, or is positioned asymmetrically in the chain, as in (for example) a branched-chain sulphosuccinate monoester, the surfactant (a)(ii) can be omitted entirely, although its presence may aid processing or provide other ancillary benefits. In terms of the general formulae I and II above, these "secondary" surfactants are materials in which $R_1$ and $R_2$, or $R_3$ and $R_4$, are of lengths that differ significantly from one another. On the other hand, if the "secondary" surfactant (a)(i) is a highly symmetrical material in which $R_1$ and $R_2$, or $R_3$ and $R_4$, are of approximately the same chain length, a "primary" or nonionic surfactant (a)(ii) may be essential in order to obtain hexagonal phase at all. Dialkyl sulphosuccinates and di(fatty alkyl) dimethyl ammonium salts fall into this class.

Preferred surfactants (a)(ii) are ethoxylated nonionic surfactants, notably ethoxylated aliphatic alcohols and ethoxylated alkyl phenols. These generally contain at least 8 aliphatic carbon atoms, preferably 10 to 18, the limits being determined, as with the "secondary" surfactant (a)(i), by surface activity and the Krafft point of the whole surfactant system. The average degree of ethoxylation may range, for example, from 5 to 30: the longer the hydrocarbon chain, the larger the number of ethoxy groups that can be tolerated.

A second group of preferred surfactants (a)(ii) suitable for use in anionic systems is constituted by the alkyl ether sulphates. Chain length, degree of ethoxylation and cation may be chosen according to the criteria already advanced for the other surfactants mentioned.

A third group of "primary" surfactants (a)(ii) is constituted by the soaps of fatty acids. Chain length and cation may again be chosen according to previously indicated criteria. Soaps are not preferred for use in high-foaming compositions, for example, for dishwashing, but are useful in compositions for fabric washing because they behave both as surfactants and as builders.

The surfactant (a)(ii) may advantageously constitute from 10 to 65% by weight of the surfactant system (a).

The surfactant system may also contain minor amounts, for example, up to 25% by weight, of fatty acid mono- and diethanolamides, in order to enhance foaming performance. These may, for example, constitute up to 10% by weight of the composition as a whole.

The second essential component in the gels of the invention is the "additive" (b). Without this material the transition into the hexagonal phase will not take place. The additive is a water-soluble non-micelle-forming or weakly micelle-forming material capable of forcing the "secondary" surfactant into hexagonal phase. The mechanism of action of the "additive" is not clearly understood; it is possible that it acts so as to increase micelle or liquid crystal curvature, but the scope of the invention is not to be limited by this hypothesis. Empirically it has been observed that some materials useful as hydrotropes in light-duty liquid detergent compositions may behave as "additives" in the sense of the present invention. These are generally molecules containing a large polar group and, optionally, a small hydrophobic group, such as an aliphatic or araliphatic chain containing not more than 6, preferably 4 or less, aliphatic carbon atoms. The larger the polar head group, the larger the hydrophobe that can be tolerated.

The polar group of the additive may carry an ionic charge, but if so this must be of the same polarity as that of the surfactant or surfactants. Materials that are in effect short-chain analogues of the "secondary" surfactants themselves may advantageously be used. For example, the lower aryl or alkylaryl sulphonates, such as toluene and xylene sulphonates, may be used as "additives" for compositions based on detergent-chain-length alkylbenzene sulphonates. They are also useful in conjunction with other sulphonates, for example, secondary alkane sulphonates, of which they are not exact structural analogues, and in conjunction with sulphates, for example, secondary alkyl sulphates. Thus one preferred type of "additive" has the same or a similar polar head group as the surfactant (a)(i) but has a relatively short hydrocarbon chain containing at most 6, and preferably not more than 4, aliphatic carbon atoms.

Similarly short chain ammonium salts, such as triethanolamine hydrochloride or lower alkylbenzene dimethyl ammonium hydrochlorides, may be used as "additives" when the "secondary" surfactant is cationic.

A second preferred type of "additive" is a highly polar but uncharged material. This type of "additive" may be used in conjunction with both anionic and cationic surfactants. Short chain analogues of nonionic surfactants may, for example, be used.

A second type of uncharged "additive" is typified by the lower amides, containing the $$-\underset{|}{CON}-$$

group. Common features of this second type appear to be an ability to raise the dielectric constant of water combined with a structure-breaking effect on water. The preferred material, which is both cheap and environmentally unobjectionable, is urea. Short-chain urea homologues and analogues, for example, methyl and ethyl ureas, thiourea, formamide and acetamide, are possible alternatives, but these are of less interest than urea itself in view of various drawbacks such as cost, toxicity or simply a lesser effectiveness as an "additive".

The third essential component of the gels of the invention is water. The relative proportions of the three ingredients for any particular surfactant and any particular additive required for hexagonal phase formation can be inferred from the relevant triangular phase diagram, which will be discussed in more detail below. They will obviously depend on the chemical nature of the surfactant system and the additive.

A further prerequisite of the compositions of the invention is that the electrolyte level be kept below a certain critical value, which will vary with the electrolyte, surfactant and "additive" concerned. The hexagonal phase region shrinks as the electrolyte level rises, and for some systems will disappear entirely from the phase diagram above a particular level. It is therefore important that a surfactant raw material of sufficiently low electrolyte content be used. For example, in alkylbenzene sulphonates the principal electrolytic impurity is inorganic sulphate (sodium sulphate in sodium alkylbenzene sulphonates); it has been found, for example, that for sodium alkylbenzene sulphonate/urea/water gels according to the invention the sodium sulphate level is preferably below 6%, based on the alkylbenzene sulphonate, while corresponding formulations based on a large organic countercation, for example, triethanolamine can tolerate rather higher sulphate levels.

One class of electrolytes that might advantageously be added to the compositions of the invention is constituted by water-soluble inorganic and organic builders, for example, phosphates, citrates or nitrilotriacetates. As indicated in the previous paragraph, care must be taken not to exceed the critical electrolyte level for any particular formulation. Compositions in which the (anionic) surfactant system is wholly or partially in the form of a salt of a large organic cation, such as triethanolamine, will tolerate higher levels, for example, 15% by weight, of such builders than will sodium-salt-based formulations, where an upper limit of about 5% by weight appears to apply.

Water-soluble organic builders that are micelle-forming, notably soap, can be incorporated at rather higher levels if desired, because they form part of the hexagonal phase structure. Soap is of course also functioning here as a "primary" cosurfactant.

As indicated previously, the compositions of the invention may if desired contain perfume at the conventional levels used in detergent compositions, for example, 0.1 to 0.3% by weight, but higher levels of "additive" are generally required when perfume is present.

If the "additive" is urea, a buffering agent is advantageously present in order to minimise acid or alkaline hydrolysis of the urea. If this is a strong electrolyte, its level should be kept as low as possible, for the reasons given earlier. A preferred buffer is boric acid, preferably used in an amount of less than 3% by weight, more preferably from 1 to 2% by weight. As also mentioned earlier, buffering may instead be achieved by including triethanolamine as a countercation in the surfactant system. The buffering capability and greater electrolyte tolerance of triethanolamine as countercation allow the possibility of incorporating significant quantities of builder electrolytes such as sodium tripolyphosphate in combination with pH-sensitive "additives" such as urea.

As previously indicated, the compositions of the invention may if desired contain solids suspended in the hexagonal phase gel, although the translucency of the compositions will decrease with increasing solids content. Solids that might be present include insoluble inorganic builders such as zeolite; partially soluble builder salts such as sodium tripolyphosphate at concentrations above their solubility limits, provided that the surfactant system and counterion selected will tolerate this; and abrasives such as silica. Calcite is preferably not used as an abrasive if urea is used as the "additive", because of its tendency to raise the pH and cause urea decomposition.

For mixtures of any particular surfactant system, "additive" and water a triangular phase diagram can be constructed from which the compositional requirements for hexagonal phase formation can be inferred. Samples at various ratios are prepared by mixing, and the phases present can be recognised without difficulty by visual appearance, gross flow properties, appearance in polarised light, and texture observed in a polarising microscope. A similar exercise can be carried out to determine the levels of additional ingredients that can be tolerated.

Compositions of the invention are conveniently prepared by mixing a "surfactant part" with an "additive part". The "surfactant part" contains the surfactants, water and any other optional ingredients such as suspended solids, buffer, perfume and colourants. The "additive part" comprises either neat "additive" (for example, urea powder), a slurry or, preferably, a concentrated solution of the "additive" in water. In the preferred case, the "additive" is used neat or dissolved in as little water as necessary, and the water, or the remaining water, is included in the "surfactant part".

Hexagonal phase gels are stiff and difficult to handle at ambient temperatures; processing can, however, be facilitated by heating the mixture as this reduces the stiffness of the hexagonal phase. For certain formulations heating can take the mixture temporarily out of the hexagonal phase region, and hence processing becomes relatively easier; temperature effects are discussed in more detail below. The hexagonal phase will form when the mixture cools down to ambient temperature. If the "additive" is urea, the temperature should be kept below 70° C., preferably below 55° C., to avoid significant hydrolytic decomposition of the urea to give ammonia.

Because the hexagonal phase gels of the invention are so stiff, aeration during preparation can present a problem; air entrained during the mixing process tends to remain trapped in the gel, spoiling its appearance. This problem can be alleviated by operating under vacuum. Certain compositions, which can be temporarily taken out of hexagonal phase by raising the temperature, can be deaerated by holding them at this elevated temperature for a sufficient length of time. The deaerated hexagonal phase will reform on cooling.

Gels of the invention in which the "secondary" surfactant is an alkylbenzene sulphonate are of especial interest. Both linear and branched material, having an average of 8 to 15 alkyl carbon atoms, preferably 10 to 13 carbon atoms, may be used. Preferred "additives" for use in conjunction with alkylbenzene sulphonates are sodium toluene and xylene sulphonates and, above all, urea.

Gels of the invention which contain alkylbenzene sulphonate may advantageously be prepared by a variant of the process described in which the "surfactant part" is prepared by in-situ neutralisation of the alkylbenzene sulphonic acid, for example, with sodium hydroxide solution, with an amine such as triethanolamine, or with magnesium oxide.

The more branched the alkyl chain of the alkylbenzene sulphonate, the more urea will be required. The upper limit for urea content is limited by its solubility (about 55% by weight in pure water); other more soluble additives can be used at higher levels.

In this embodiment, the surfactant system preferably contains from 45–100% alkylbenzene sulphonate, 0–55% ethoxylated nonionic surfactant and/or alkyl ether sulphate, and 0–25% fatty acid mono- or diethanolamide.

Preferred compositions based on alkylbenzene sulphonates contain the following proportions of ingredients:

| | Weight % of gel |
|---|---|
| alkylbenzene sulphonate: | 20–60, preferably 20–55 |
| ethoxylated nonionic surfactant and/or alkyl | 0–30, preferably 0–20 |

-continued

| | Weight % of gel |
|---|---|
| ether sulphate: | |
| fatty acid diethanolamide | 0–10 |
| urea: | 1–45, preferably 8–30 |
| phosphate builder: | 0–15 |
| boric acid (buffer): | 0–2 |
| water: | 20–65, preferably 25–45 |

minor ingredients to 100% plus optional suspended builder or abrasive (preferred solid to gel ratio up to 0.43:1).

Compositions based on $C_4$–$C_{10}$ dialkyl sulphosuccinates are also of interest. Especially preferred ingredients, on grounds of foaming performance, are $C_6$–$C_8$ dialkyl sulphosuccinates, for example, those described and claimed in GB No. 2 108 520A, GB No. 2 105 325A and GB No. 2 133 793A (Unilever). These are preferably linear.

A "primary" or nonionic surfactant (a)(ii) appears to be essential when the "secondary" surfactant is a dialkyl sulphosuccinate. This is preferably an alkyl ether sulphate, if very high foaming performance is required.

In this embodiment, the surfactant system may advantageously contain 30–60% by weight of dialkyl sulphosuccinate, 40–70% by weight of alkyl ether sulphate and/or ethoxylated nonionic surfactant, and 0–25% by weight of fatty acid mono- or diethanolamide.

Preferred compositions may contain, for example, 15–20% by weight of dialkyl sulphosuccinate, 20–25% by weight of alkyl ether sulphate, 10–20% by weight of urea, and 40–50% by weight of water, plus the usual minor ingredients. As with previous compositional limits, the percentage base here does not include any suspended solid that might be present.

The invention will now be described in more detail, by way of example only, with reference to the accompanying drawings, in which FIGS. 1 to 6 represent triangular phase diagrams for some alkylbenzene sulphonate/"additive"/water systems. All the alkylbenzene sulphonates used were sodium salts.

Referring now to FIG. 1 of the accompanying drawings, a triangular phase diagram at 22° C. for a system based on the sodium linear alkylbenzene sulphonate Marlon (Trade Mark) A 396 ex Chemische Werke Hüls, Germany, is shown. This material has an average molecular weight of 342 and contains less than 1.0% by weight of electrolyte (sodium sulphate), based on the alkylbenzene sulphonate.

In the phase diagram, the sodium alkylbenzene sulphonate is designated as ABS. $L_1$ denotes isotropic (micellar solution), $L_\alpha$ denotes lamellar phase and H denotes hexagonal phase.

It will be noted that there is a broad area of hexagonal phase covering about 35–50% sodium alkylbenzene sulphonate, about 10–35% urea and about 25–55% water. The area is limited at the upper end of the diagram (point U) by the solubility of urea (about 55% by weight in pure water). As the hexagonal phase is approached from the water or (water+alkylbenzene sulphonate) side of the diagram, as is done in practice, the phase adjacent to hexagonal (H) is a mixture of H with isotropic (micellar) solution $L_1$. This mixture flows much more readily than does hexagonal phase itself. During mixing it is thus relatively easy to detect the endpoint when sufficient urea has been added to effect the transition into hexagonal phase: as urea is added, at a temperature of about 50° C., small samples may be removed and allowed to cool to ambient temperature, and if they become rigid on cooling this indicates that the hexagonal phase area has been entered.

Similar diagrams have been constructed for other commercially available alkylbenzene sulphonates, both linear and branched; the size and position of the hexagonal phase region does not vary greatly. FIG. 2 compares the hexagonal phase boundaries for the sodium salt of Marlon A 396 (line A) with those for two other commercially available sodium linear alkylbenzene sulphonates: Dobane (Trade Mark) 102 ex Shell (average molecular weight 339, sodium sulphate content 2.4%), (line B) and Petrelab (Trade Mark) 550 ex Petresa (average molecular weight 342, sodium sulphate content 1.8%), (line C).

FIG. 3 shows the effect of temperature on the hexagonal phase boundaries of the sodium Dobane 102/urea/water system. As the temperature is raised from 22° C. to 37° C., and again to 50° C., the hexagonal phase region diminishes in size and at 75° C. no stable hexagonal phase is observed. Compositions between the hexagonal phase boundaries at 22° C. and at 50° C. can readily be prepared by mixing at 50° C., at which temperature they are free-flowing and easy to handle, and on cooling they will transform to the much stiffer hexagonal phase.

FIG. 4 shows the effect of electrolyte (sodium sulphate) level on the same ternary system, at 22° C. The lowest figure investigated, 2.4% by weight on total active matter, represented the level of the salt inherently present in the alkylbenzene sulphonate raw material. It will be seen that the hexagonal phase area shrinks rapidly with increasing electrolyte level; at 12% sodium sulphate no hexagonal phase could be observed.

FIG. 5 shows the effect on the phase diagram at 22° C. of including a "primary" surfactant, an alkyl ether sulphate; in FIG. 5, the alkylbenzene sulphonate/alkyl ether sulphate mixture is designated as "ACTIVE". The mixed system investigated, indicated by a broken line, was 80% alkylbenzene sulphonate (Dobane 102) and 20% alkyl ether sulphate; the solid line represents 100% Dobane 102.

FIG. 6 shows a phase diagram at 22° C. for a ternary system using a different "additive", sodium toluene sulphonate, designated as "STS". The surfactant is the sodium salt of Marlon A 396 as in FIG. 1. The point S represents the solubility limit of sodium toluene sulphonate. It will be seen that the hexagonal phase region is much smaller than with the corresponding system containing urea.

The invention is further illustrated by the following non-limiting Examples, in which parts and percentages are by weight unless otherwise stated, and refer to 100% active material.

EXAMPLE 1

A hexagonal phase gel was prepared to the following composition:

| | % |
|---|---|
| Linear alkylbenzene sulphonate, sodium salt: Dobane [Trade Mark] 102 ex Shell | 40 |
| Urea | 15 |
| Yellow dye | 0.0003 |
| Perfume | 0.25 |
| Water | to 100 |

The method of preparation was as follows. 71.4 parts of alkylbenzene sulphonate, in the form of a paste containing 56% active matter, were heated to 50° C. and mixed with 0.5 parts of 0.6% dye solution, 0.25 parts of perfume and 0.55 parts of water. In a separate vessel, 15 parts of solid urea were dissolved in 12.3 parts of water by warming to about 50° C. The urea solution was then stirred into the alkylbenzene sulphonate slurry until a homogeneous hexagonal phase gel was obtained. This aerated gel was liquefied and allowed to de-aerate by maintaining it at 75° C. for 3 to 4 hours. At room temperature the product was a stiff, translucent yellow gel of attractive appearance.

EXAMPLE 2

A hexagonal phase gel was prepared to the following composition:

| | % |
|---|---|
| Linear alkylbenzene sulphonate, sodium salt: Petrelab Trade Mark 550 ex Petresa. | 35 |
| Urea | 20 |
| Boric acid | 2 |
| Water | to 100 |

The method of preparation was as follows. A 55% by weight urea solution, representing the maximum concentration possible at ambient temperature, was prepared by dissolving 20 parts of urea in 16.4 parts of water at about 50° C. 33.8 parts of alkylbenzene sulphonic acid (97% active matter), together with 2 parts of boric acid, were neutralised to pH 7 with 9 parts of a 50% aqueous solution of sodium hydroxide in the presence of the residual water (18.8 parts). Because of the evolution of heat during neutralisation this mixture too was at a temperature above ambient. The urea solution was stirred into the surfactant mix until a homogeneous hexagonal phase gel was obtained.

EXAMPLE 3

By a method essentially as described in Example 2, a hexagonal phase gel using a different "additive", sodium toluene sulphonate, was prepared: the process differed only in that the "additive" was in slurry, rather than solution, form. The composition was as follows:

| | % |
|---|---|
| Linear alkylbenzene sulphonate, sodium salt: Marlon (Trade Mark) A ex Huls | 40 |
| Sodium toluene sulphonate | 20 |
| Water | to 100 |

EXAMPLE 4

By the method described in Example 2, a hexagonal phase gel containing a "hard" (branched) alkylbenzene sulphonate was prepared to the following composition:

| | % |
|---|---|
| Branched alkylbenzene sulphonate, sodium salt: Oronite (Trade Mark) 60 ex Chevron | 35 |
| Urea | 25 |
| Water | to 100 |

It will be noted that a slightly higher level of urea than in Example 2 was required.

EXAMPLE 5

By the method described in Example 2, a hexagonal phase gel containing a slightly higher level of "hard" alkylbenzene sulphonate was prepared to the following composition:

| | % |
|---|---|
| Branched alkylbenzene sulphonate, sodium salt: DDB (Trade Mark) ex Petkim | 40 |
| Urea | 20 |
| Water | to 100 |

With this particular branched material, the level of urea required was no higher than for the linear material used in Example 3.

EXAMPLE 6

A hexagonal phase gel containing alkylbenzene sulphonate and alkyl ether sulphate was prepared to the following composition:

| | % |
|---|---|
| Linear alkylbenzene sulphonate, sodium salt: Dobane 102 | 32 |
| Alkyl ether sulphate, sodium salt: Synperonic (Trade Mark) 3-S-70 ex ICI | 8 |
| Urea | 25 |
| Water | to 100 |

The method of preparation was essentially as described in Example 2, except that all of the free water was added at the neutralisation stage, and the alkyl ether sulphate (as a 70% active matter paste) was then mixed with the alkylbenzene sulphonate before addition of the urea as a powder.

EXAMPLE 7

By the method described in Example 2, a hexagonal phase gel was prepared to the following composition:

| | % |
|---|---|
| Linear alkylbenzene sulphonate, sodium salt: Petrelab 550 | 30 |
| Urea | 25 |
| Water | to 100 |

EXAMPLE 8

By a method essentially as described in Example 2, a hexagonal phase gel containing alkylbenzene sulphonate in triethanolamine salt form was prepared, the neutralisation being carried out with liquid triethanolamine rather than with sodium hydroxide solution. The composition was as follows:

| | % |
|---|---|
| Linear alkylbenzene sulphonate, triethanolamine salt: Petrelab 550 | 55 |
| Urea | 8 |
| Water | to 100 |

The low urea requirement will be noted.

EXAMPLE 9

A hexagonal phase gel containing alkylbenzene sulphonate and nonionic surfactant was prepared to the following composition:

| | % |
|---|---|
| Linear alkylbenzene sulphonate, triethanolamine salt: Petrelab 550 | 40 |
| Ethoxylated $C_{12}$–$C_{15}$ aliphatic alcohol (9EO): Dobanol (Trade Mark) 25-9 ex Shell | 5 |
| Urea | 30 |
| Water | to 100 |

The method of preparation was essentially as described in Example 6: again triethanolamine was used to neutralise the alkylbenzene sulphonic acid, and the nonionic surfactant was mixed with the alkylbenzene sulphonate before addition of the urea powder.

EXAMPLE 10

By the method described in Example 2, a hexagonal phase gel containing a relatively high level of sodium alkylbenzene sulphonate was prepared to the following composition:

| | % |
|---|---|
| Linear alkylbenzene sulphonate, sodium salt: Marlon A ex Huls | 48 |
| Urea | 12 |
| Water | to 100 |

EXAMPLE 11

A hexagonal phase gel containing a sodium alkylbenzene sulphonate and a low level of soluble inorganic builder was prepared to the following composition:

| | % |
|---|---|
| Linear alkylbenzene sulphonate, sodium salt: Marlon A | 40 |
| Sodium hexametaphosphate | 5 |
| Urea | 30 |
| Water | to 100 |

The method of preparation was essentially as described in Example 6, the solid sodium hexametaphosphate builder being mixed with the alkylbenzene sulphonate before addition of the urea powder.

EXAMPLE 12

A hexagonal phase gel containing a triethanolamine alkylbenzene sulphonate and a higher level of inorganic builder was prepared to the following composition:

| | % |
|---|---|
| Linear alkylbenzene sulphonate, triethanolamine salt: Petrelab 550 | 40 |
| Sodium tripolyphosphate: Thermophos (Trade Mark) NW ex Knapsack | 10 |
| Urea | 25 |
| Water | to 100 |

The method of preparation was as follows. The sodium tripolyphosphate was slurried in the free water at about 50° C., the triethanolamine was added, and the alkylbenzene sulphonic acid was then added for neutralisation. Urea as a powder was finally mixed in. In this method the sodium tripolyphosphate was not allowed to come into contact with the free alkylbenzene sulphonic acid because of the risk of hydrolysis.

EXAMPLE 13

By the method of Example 12, a hexagonal phase gel was prepared to the following composition:

| | % |
|---|---|
| Linear alkylbenzene sulphonate, triethanolamine salt: Petrelab 550 | 40 |
| Sodium tripolyphosphate: Thermophos NW | 15 |
| Urea | 25 |
| Water | to 100 |

This gel was less translucent than that of Example 12 because the phosphate builder was partially in suspended solid form.

EXAMPLE 14

A hexagonal phase gel containing dialkyl sulphosuccinate and alkyl ether sulphate was prepared to the following composition:

| | % |
|---|---|
| $C_6/C_8$ dialkyl sulphosuccinate, sodium salt: a mixed linear $C_6/C_8$ dialkyl sulphosuccinate prepared from a mixture of 40 mole % n-hexanol and 60 mole % n-octanol as described in GB 2 108 520A (Unilever) | 20 |
| Alkyl ether sulphate, sodium salt: Synperonic 3-S-70 | 20 |
| Urea | 20 |
| Water | to 100 |

The dialkyl sulphosuccinate, in the form of an 80% active matter paste, was mixed with the alkyl ether sulphate (as a 70% active matter paste) and the free water, and urea solution was stirred in as described in Example 1.

EXAMPLE 15

By the method described in Example 14, a hexagonal phase gel was prepared to the following composition:

| | % |
|---|---|
| $C_6/C_8$ dialkyl sulphosuccinate, sodium salt (as in Example 14) | 15 |
| Alkyl ether sulphate: Synperonic 3-S-70 | 25 |
| Urea | 10 |
| Water | to 100 |

EXAMPLE 16

A hexagonal phase gel containing a fatty acid diethanolamide was prepared to the following composition:

| | % |
|---|---|
| Linear alkylbenzene sulphonate, sodium salt: Petrelab 550 | 30 |
| Coconut diethanolamide: Ethylan (Trade Mark) LD ex Diamond Shamrock | 5 |
| Urea | 16 |
| Boric acid | 2 |

-continued

| | % |
|---|---|
| Water | to 100 |

The method of preparation was essentially as described in Example 6, the coconut diethanolamide (100% active matter) being mixed with the alkylbenzene sulphonate before addition of the urea powder.

EXAMPLE 17

A hexagonal phase gel containing alkylbenzene sulphonate, alkyl ether sulphate, and coconut diethanolamide was prepared to the following composition:

| | % |
|---|---|
| Linear alkylbenzene sulphonate, sodium salt: Petrelab 550 | 28 |
| Alkyl ether sulphate, sodium salt: Synperonic 3-S-70 | 2 |
| Coconut diethanolamide: Ethylan LD | 10 |
| Urea | 20 |
| Boric acid | 2 |
| Water | to 100 |

The method of preparation was essentially as described in Example 6, the coconut diethanolamide and alkyl ether sulphate being mixed with the alkylbenzene sulphonate before addition of the urea powder.

EXAMPLE 18

By a method substantially as described in Example 9, a hexagonal phase gel containing an alkylbenzene sulphonate partially in triethanolamine salt form and also containing a nonionic surfactant and a fatty acid diethanolamide was prepared. Neutralisation was carried out using a mixture of sodium hydroxide solution and triethanolamine. The composition was as follows:

| | % |
|---|---|
| Linear alkylbenzene sulphonate, sodium salt: Petrelab 550 | 17.5 |
| Linear alkylbenzene sulphonate, triethanolamine salt: Petrelab 550 | 16.0 |
| Nonyl phenol 10EO ethoxylate: Dowfax (Trade Mark) 9N10 | 5.0 |
| Coconut diethanolamide: Comperlan (Trade Mark) KD ex Henkel | 0.5 |
| Urea | 16.0 |
| Perfume | 0.3 |
| Dye | 0.0003 |
| Water | to 100 |

EXAMPLE 19

A hexagonal phase gel containing an alkylbenzene sulphonate and a higher level of an ethoxylated alcohol nonionic surfactant was prepared to the following composition:

| | % |
|---|---|
| Linear alkylbenzene sulphonate, sodium salt: Petrelab 550 | 20 |
| Ethoxylated $C_{12}$–$C_{15}$ aliphatic alcohol (9EO): Dobanol 25-9 | 20 |
| Urea | 15 |
| Water | to 100 |

The method of preparation was essentially as described in Example 2, the nonionic surfactant being mixed with the alkylbenzene sulphonate before addition of the urea solution.

EXAMPLE 20

By the method described in Example 19, a similar hexagonal phase gel containing a more highly ethoxylated nonionic surfactant was prepared to the following composition:

| | % |
|---|---|
| Linear alkylbenzene sulphonate, sodium salt: Petrelab 550 | 20 |
| Ethoxylated $C_{12}$–$C_{15}$ aliphatic alcohol (12EO): Dobanol 25-12 | 20 |
| Urea | 20 |
| Water | to 100 |

EXAMPLE 21

A hexagonal phase gel containing an alkylbenzene sulphonate and a higher level of alkyl ether sulphate was prepared to the following composition:

| | % |
|---|---|
| Linear alkylbenzene sulphonate, sodium salt: Petrelab 550 | 20 |
| Alkyl ether sulphate, sodium salt: Synperonic 3-S-70 | 20 |
| Urea | 15 |
| Water | to 100 |

The method of preparation was essentially as described in Example 2, the alkyl ether sulphate being mixed with the alkylbenzene sulphonate before addition of the urea solution.

EXAMPLE 22

A hexagonal phase gel containing alkylbenzene sulphonate in magnesium salt form and alkyl ether sulphate was prepared to the following composition:

| | % |
|---|---|
| Linear alkylbenzene sulphonate, magnesium salt: Petrelab 550 | 20 |
| Alkyl ether sulphate, sodium salt: Synperonic 3-S-70 | 14 |
| Urea | 20 |
| Water | to 100 |

The method of preparation was essentially as described in Example 6, except that the neutralisation was carried out by adding the amount of magnesium oxide required to form 20 parts of alkylbenzene sulphonate, with final adjustment to pH 7 using sodium hydroxide solution.

EXAMPLE 23

A detergent composition in the form of a hexagonal phase gel containing a suspended solid abrasive was prepared to the following composition:

| | % of whole | % of gel |
|---|---|---|
| Linear alkylbenzene sulphonate, | 28 | 40 |

-continued

| | % of whole | % of gel |
|---|---|---|
| sodium salt: Petrelab 550 | | |
| Urea | 14 | 20 |
| Boric acid | 1.4 | 2 |
| Silica, mean particle size 8–10 μm: Gasil 200 ex Crosfield Chemicals | 30 | — |
| Perfume | 0.21 | 0.3 |
| Dye | 0.0002 | 0.0003 |
| Water | to 100 | to 100 |

This gel, suitable for hard surface cleaning, was considerably more opaque than those of the foregoing Examples owning to the presence of suspended solid, but retained some translucency. The weight ratio of solid to gel here was 30:70 (0.43:1).

The method of preparation was essentially as described in Example 2, the silica abrasive being mixed with the surfactant before addition of the urea solution.

EXAMPLE 24

By the method of Example 23, an opaque detergent composition suitable for fabric washing and containing a insoluble inorganic builder, zeolite (crystalline sodium aluminosilicate), suspended in a hexagonal phase gel, was prepared to the composition given below. The weight ratio of solid to gel was again 0.43:1.

| | % of whole | % of gel |
|---|---|---|
| Linear alkylbenzene sulphonate, sodium salt: Petrelab 550 | 28 | 40 |
| Urea | 14 | 20 |
| Boric acid | 1.4 | 2 |
| Zeolite, mean particle size 4 μm: Zeolite HAB40 ex Degussa | 30 | — |
| Perfume | 0.21 | 0.3 |
| Dye | 0.0002 | 0.0003 |
| Water | to 100 | to 100 |

EXAMPLE 25

A hexagonal phase gel suitable for fabric washing, and containing soap as a soluble organic builder and cosurfactant, was prepared to the following composition:

| | % |
|---|---|
| Linear alkylbenzene sulphonate, sodium salt: Dobane 102 | 32 |
| Sodium oleate | 4 |
| Sodium linoleate | 4 |
| Urea | 28 |
| Water | to 100 |

The method of preparation was essentially as described in Example 6, the soaps being mixed with the alkylbenzene sulphonate before addition of the urea powder.

EXAMPLE 26

A hexagonal phase gel based on cationic surfactants (one "secondary" and one "primary") was prepared to the following composition:

| | % |
|---|---|
| Dicoconut dimethyl ammonium chloride: Arquad (Trade Mark) 2C ex Akzo | 20 |
| Hexadecyl trimethyl ammonium chloride: Arquad 16 ex Akzo | 20 |
| Urea | 15 |
| Water | to 100 |

This product is useful for fabric conditioning or hair conditioning.

The method of preparation was as follows. Solvent was removed from the commercially supplied Arquad 2C by rotary evaporation, and the purified material was mixed directly with the Arquad 16 (100% active matter), urea powder and water at about 30° C. until a homogeneous hexagonal phase gel resulted.

Note

None of the surfactant systems used in the Examples would form hexagonal phase gels in the absence of the "additive".

EXAMPLE 27

The dishwashing performance of the gel prepared in Example 1 was compared to that of three paste products currently commercially available in Turkey, using a standardised test procedure in which soiled plates were washed to a foam collapse end point. Each plate was pre-soiled with 5 g of a standard cooking oil/starch-/fatty acid emulsion in water, and the washing solution in each case consisted of 7.5 g of product dissolved in 5 liters of water (12° French hardness) at 45° C., that is to say, a whole-product concentration of 1.5 g/liter.

The three commercial products tested, designated A, B and C, were all in the form of opaque off-white pastes and contained the following principal ingredients (%):

| | A | B | C |
|---|---|---|---|
| Alkylbenzene sulphonate | 25[1] | 20[2] | 25[1] |
| Sodium bicarbonate | 6 | 16 | 8 |
| Sodium sulphate | 17 | 11 | 31 |
| Sodium tripolyphosphate | 14 | 6 | — |
| Water and minors | | to 100 | |

[1]mixture of "hard" (branched) and linear alkylbenzene sulphonates
[2]"hard" alkylbenzene sulphonate The results of the plate washing test, expressed as the number of plates washed before foam collapse, are shown in the following Table. Each figure is the mean of two results.

| | |
|---|---|
| Gel of Example 1 | 47.5 |
| Paste A | 10 |
| Paste B | 12 |
| Paste C | 23.5 |

It will be seen that the gel of the invention was capable of washing approximately twice as many plates as the best (C) of the commercial products.

EXAMPLE 28

The comparison of Example 22 was carried out at equal product dosage, and thus represents the differences that might be perceived under realistic user conditions, but the products compared contained different amounts of surfactant. A further performance evaluation was accordingly carried out to compare the various products at equal surfactant concentration in the wash solution (0.375 g/liter of alkylbenzene sulphonate). The results are shown below; again each figure represents the mean of two results.

| Product | Concentration (g/liter) | Plates washed |
|---|---|---|
| Gel 1 | 0.94 | 20.5 |
| A | 1.50 | 10 |
| B | 1.88 | 17 |
| C | 1.5 | 23.5 |

It will be seen that, at constant active detergent level, the gel substantially matched the best (C) of the commercial products, and was considerably better than the worst of them (A).

We claim:

1. A detergent composition comprising a gel wholly or predominantly in hexagonal liquid crystal form, said gel comprising:

(a) from 15 to 70% by weight of a surfactant system having a Krafft point below ambient temperature, said system being incapable of forming hexagonal phase spontaneously, and consisting essentially of:

(i) 30 to 100% by weight of an anionic or cationic surfactant, having a polar head group and one or more linear or branched aliphatic or araliphatic hydrocarbon chains containing in total at least 8 aliphatic carbon atoms, the polar head group being positioned non-terminally in a single hydrocarbon chain or carrying more than one hydrocarbon chain; or two or more such surfactants of the same charge type; and (ii) 0 to 70% by weight of a further surfactant selected from surfactants of the same charge type as (i) but having a polar head group positioned terminally in a linear or branched aliphatic or araliphatic hydrocarbon chain containing at least 8 aliphatic carbon atoms; nonionic surfactants; and mixtures thereof;

(b) from 1 to 45% by weight of an additive which is a water-soluble non-micelle-forming or weakly micelle-forming material capable of forcing the surfactant system (a) into hexagonal phase, said additive having at most 6 aliphatic carbon atoms and being selected from the group consisting of aryl or alkylaryl sulfonates, ammonium salts, amides and mixtures thereof, the additive being nonionic or of the same charge type as the surfactant (a) (i); and (c) at least 20% by weight of water.

2. A detergent composition as claimed in claim 1, wherein the hydrocarbon chains of the surfactant (a)(i) contain in total from 10 to 28 aliphatic carbon atoms.

3. A detergent composition as claimed in claim 1, wherein the hydrocarbon chain of the surfactant (a)(ii) contains from 10 to 18 aliphatic carbon atoms.

4. A detergent composition as claimed in claim 1, wherein the additive (b) has a hydrocarbon chain containing at most 4 aliphatic carbon atoms.

5. A detergent composition as claimed in claim 1, wherein the additive (b) is area.

6. A detergent composition as claimed in claim 1, wherein the gel contains from 25 to 60% by weight of the surfactant system (a).

7. A detergent composition as claimed in claim 1, wherein the gel contains from 5 to 35% by weight of the additive (b).

8. A detergent composition as claimed in claim 1, wherein the gel contains from 25 to 55% by weight of water.

9. A detergent composition as claimed in claim 1, wherein the surfactant system (a) comprises from 10 to 65% by weight of the further surfactant (a)(ii).

10. A detergent composition as claimed in claim 1, wherein the surfactant (a)(i) is anionic.

11. A detergent composition as claimed in claim 10, wherein the surfactant (a)(i) comprises a linear or branched alkylbenzene sulphonate containing an average of from 8 to 15 alkyl carbon atoms.

12. A detergent composition as claimed in claim 10, wherein the surfactant (a)(i) comprises a linear or branched alkylbenzene sulphonate containing an average of from 10 to 13 alkyl carbon atoms.

13. A detergent composition as claimed in claim 10, wherein the surfactant system (a) consists essentially of:

(i) from 45 to 100% by weight of one or more linear or branched $C_8$–$C_{15}$ alkylbenzene sulphonates, and (ii) from 0 to 55% by weight of one or more further surfactants selected from alkyl ether sulphates, ethoxylated nonionic surfactants, fatty acid soaps and mixtures thereof, and (iii) from 0 to 25% by weight of one or more fatty acid mono- or diethanolamides or mixtures thereof.

14. A detergent composition as claimed in claim 10, wherein the surfactant (a)(i) comprises a liner or branched di($C_4$–$C_{10}$) alkyl sulphosuccinate.

15. A detergent composition as claimed in claim 10, wherein the surfactant (a)(i) comprises a linear di($C_6$–$C_8$) alkyl sulphosuccinate.

16. A detergent composition as claimed in claim 10, wherein the surfactant system (a) consists essentially of (a)(i) from 30 to 60% by weight of one or more di($C_4$–$C_{10}$) alkyl sulphosuccinates, and (a)(ii) from 40 to 70% by weight of one or more further surfactants selected from alkyl ether sulphates, ethoxylated nonionic surfactants, and and mixtures thereof, and (a)(iii) from 0 to 25% by weight of one or more fatty acid mono- or diethanolamides or mixtures thereof.

17. A detergent composition as claimed in claim 1, wherein the gel contains a buffering amount, less than 3% by weight, of boric acid.

18. A detergent composition as claimed in claim 17, wherein the gel comprises from 1 to 2% by weight of boric acid.

19. A detergent composition as claimed in claim 10, wherein the anionic surfactant (a)(i) is present at least partially in trialkanolamine salt form.

20. A detergent composition as claimed in claim 10, which additionally comprises up to 15% by weight of a water-soluble inorganic or organic detergency builder.

21. A detergent composition as claimed in claim 1, which additionally comprises a solid suspended in the gel, the weight ratio of solid to gel not exceeding 1.5:1, said suspended solid being a detergency builder or an abrasive.

22. A detergent composition as claimed in claim 1, which is transparent or translucent.

23. A detergent composition as claimed in claim 1, comprising a gel consisting essentially of (a)(i) from 20 to 55% by weight of one or more linear or branched $C_8$–$C_{15}$ alkylbenzene sulphonates, (a)(ii) from 0 to 20% by weight of alkyl ether sulphate or ethoxylated nonionic surfactant or soap, (a)(iii) from 0 to 10% by weight of fatty acid diethanolamide, (b) from 8 to 30% by weight of urea or sodium toluene sulphonate, (c) from 0 to 15% by weight of water-soluble phosphate builder, (d) from 0 to 2% by weight of boric acid, (e) from 20 to 45% by weight of water.

24. A detergent composition as claimed in claim 23, further comprising a suspended water-insoluble builder or abrasive, in a weight ratio of solid to gel not exceeding 0.43:1.

25. A detergent composition as claimed in claim 1, comprising a gel consisting essentially of (a)(i) from 15 to 20% by weight of one or more linear or branched di($C_4$–$C_{10}$)alkyl sulphosuccinates, (a)(ii) from 20 to 25% by weight of alkyl ether sulphate, (b) from 10 to 20% by weight of urea, (c) from 40 to 50% by weight of water.

* * * * *